US008215237B2

(12) United States Patent
Geswender

(10) Patent No.: US 8,215,237 B2
(45) Date of Patent: Jul. 10, 2012

(54) METHODS AND APPARATUS FOR PROJECTILE DATA LINK SYSTEM

(75) Inventor: Chris E. Geswender, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 1594 days.

(21) Appl. No.: 11/456,372

(22) Filed: Jul. 10, 2006

(65) Prior Publication Data

US 2008/0006169 A1 Jan. 10, 2008

(51) Int. Cl.
*F42B 5/02* (2006.01)
*F42C 17/00* (2006.01)

(52) U.S. Cl. ..... 102/464; 102/439; 102/469; 89/6

(58) Field of Classification Search ..... 102/430, 102/464, 376, 439, 469, 206, 215; 89/6, 89/6.5

See application file for complete search history.

(56) References Cited

U.S. PATENT DOCUMENTS 1,108,717 A * 8/1914 Davis ..... 102/430
2,748,701 A 6/1956 Barrows
3,952,658 A * 4/1976 Broyles ..... 102/438
4,155,285 A * 5/1979 Kratzenberg et al. ..... 89/1.3
4,206,707 A 6/1980 Shores
4,285,153 A * 8/1981 Crouch ..... 42/84
4,438,675 A 3/1984 Fischer et al.
5,235,129 A * 8/1993 Corney ..... 102/472
5,329,840 A 7/1994 Corney
6,085,629 A 7/2000 Thiesen et al.
6,202,532 B1 * 3/2001 Kadushin ..... 89/6.5
6,374,741 B1 * 4/2002 Stanley et al. ..... 102/439
6,659,012 B1 * 12/2003 Grassl et al. ..... 102/336
6,745,697 B2 * 6/2004 Haak et al. ..... 102/472
6,796,243 B2 * 9/2004 Schmees et al. ..... 102/472
7,377,204 B2 * 5/2008 Simmons ..... 89/8
7,451,702 B1 * 11/2008 Dindl et al. ..... 102/472
7,581,499 B2 * 9/2009 Stark et al. ..... 102/472
8,042,470 B2 * 10/2011 Dietrich et al. ..... 102/215

* cited by examiner

*Primary Examiner* — James Bergin
(74) *Attorney, Agent, or Firm* — Schwegman, Lundberg & Woessner, P.A.; Gregory J. Gorrie

(57) ABSTRACT

Methods and apparatus for a data link system according to various aspects of the present invention may be incorporated into a cartridge system. The cartridge system may comprise a case and a projectile. The data link system may be connected to the case and the projectile to provide signals. The data link system a first connection point and a second connection point disposed on the case and an electrical connector connected to the first connection point and the second connection point.

6 Claims, 5 Drawing Sheets

| | |
|---|---|
| PREPARE CASE FOR LAYER FORMATION | STEP 40 |
| FORM BASE INSULATION LAYER | STEP 41 |
| FORM FIRST CONDUCTIVE LAYER | STEP 42 |
| FORM INSULATOR PADS | STEP 43 |
| FORM SECOND CONDUCTIVE LAYER | STEP 44 |
| DRY | STEP 45 |
| TEST | STEP 46 |

FIG.4

METHODS AND APPARATUS FOR PROJECTILE DATA LINK SYSTEM

FIELD OF THE INVENTION

The present invention relates to projectiles. More particularly, the invention relates to projectiles operating in conjunction with electronic systems.

BACKGROUND OF THE INVENTION

Ammunition cartridges, such as those used in cannon-fired systems, typically include as components a projectile and a case (or casing). The case typically encloses a propellant such as gunpowder. The rapid combustion of the propellant produces the high pressure that separates the projectile from the case and discharges the projectile through the cannon barrel. The projectile may also include other elements, such as fusing components, guidance components, and explosives.

Modern ammunition may include guidance components within the projectile that are computer-controlled. Prior to firing of the projectile, these guidance components can receive power and guidance data from a source outside the projectile. Guidance data may include a data initialization that includes information related to the firing vehicle's position and velocity, target vectors, weather and wind data, and other information. The data initialization may be stored within the guidance system and then retrieved during projectile flight. Power and data may be provided to the guidance system within as short a time as possible prior to firing to minimize the energy storage requirements within the guidance system. Further, it is generally desired to make the power transfer and data transfer as quickly as possible to increase the rate of fire of the cannon or other firing system, and so that the data provided be as meaningful as possible.

Many projectile systems use projectile casings of different materials. Projectile cases may be metallic or non-metallic. Typical non-metallic projectile cases are constructed of a cellulose/cardboard type material. Regardless of the type of case that is used, there is often a need to minimize fouling of the gun bore that may arise from firing activity. When a non-metallic cellulose case is used it is generally desired that the material of the case burn completely, or nearly completely, during the firing cycle so that particulate fouling and residue contamination is minimized in the bore.

SUMMARY OF THE INVENTION

Methods and apparatus for a data link system according to various aspects of the present invention may be incorporated into a cartridge system. The cartridge system may comprise a case and a projectile. The data link system may be connected to the case and the projectile to provide signals. The data link system a first connection point and a second connection point disposed on the case and an electrical connector connected to the first connection point and the second connection point.

BRIEF DESCRIPTION OF THE DRAWINGS

A more complete understanding of the present invention may be derived by referring to the detailed description and claims when considered in connection with the following illustrative figures. In the following figures, like reference numbers refer to similar elements and steps throughout the figures.

FIG. 4 is a functional flow diagram of a process for fabricating a data link system;

Elements and steps in the figures are illustrated for simplicity and clarity and have not necessarily been rendered according to any particular sequence. For example, steps that may be performed concurrently or in different order are illustrated in the figures to help to improve understanding of embodiments of the present invention.

DETAILED DESCRIPTION OF EXEMPLARY EMBODIMENTS

The present invention may be described in terms of functional block components and various processing steps. Such functional blocks may be realized by any number of hardware or software components configured to perform the specified functions and achieve the various results. For example, a system according to various aspects of the present invention may employ various connectors, insulators, conductors, transmission elements, and the like, which may carry out a variety of functions. In addition, the present invention may be practiced in conjunction with any number of armaments, communication systems, guidance systems, and computers, and the systems described are merely exemplary applications for the invention. Further, a system according to the present invention may employ any number of conventional techniques for transmitting signals, forming conductors, insulators, and connections, joining projectiles to cases, and the like.

Figure 1:
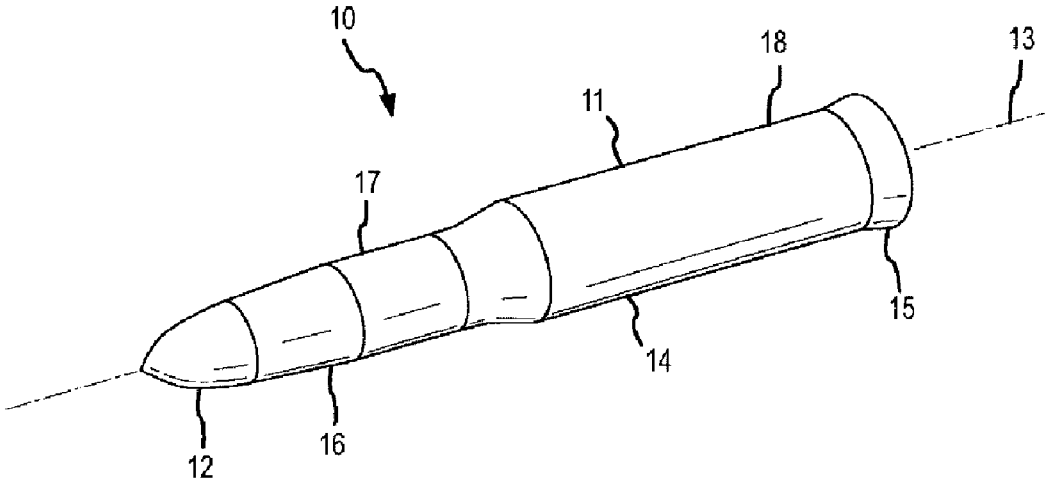
FIG. 1 is a perspective view of a cartridge system according to an embodiment of the present invention.

Referring now to FIG. 1, a cartridge system 10 according to various aspects of the present invention includes a projectile 12 and case 11. The cartridge system 10 may be configured for any suitable purpose, for example to launch a guided projectile 12, an unmanned aerial vehicle, or other system to be launched. In the present embodiment, the projectile 12 is a guidable projectile that may be provided instructions or otherwise programmed to guide the projectile to a target or along a selected path, for example in conjunction with deployable control surfaces and a guidance system onboard the projectile 12. The projectile 12 may receive guidance instructions from an external system, such as via electrical signals provided to the projectile 12.

The case 11 may comprise provide any suitable shape and/or size, such as a complex, multi-curved shape configured to mate with a gun barrel and/or tiring system. In the present embodiment, the case 11 comprises a conventional metal or cellulose case for a round fired from a cannon, tank, or other gun. The case 11 includes a forward end 17 and a base end 18. The projectile 12 is suitably joined to the forward end 17 of the case 11 prior to firing, and may be oriented along a common longitudinal axis 13. The case 11 also has an opening 16 where the projectile 12 is joined to the case 11. The case 11 suitably includes an outer surface 14, an inner surface defining a hollow interior, and a base 15. The inner surface defines an inner cavity which houses various items in the cartridge system 10, such as propellant materials. The base 15 may house other components of the cartridge system 10, such as a primer.

The case 11 may comprise any appropriate materials selected according to any suitable criteria, such as the characteristics of the projectile 12 and the launch system. The material may be either conducting or non-conducting with respect to electrical signals used in guiding the projectile 12. Non-conducting case materials do not effectively conduct electrical power signals and data signals, such as to power and program projectile-guidance systems. For example, conventional munitions may include a non-conducting cellulose or cardboard-type case material, which may substantially burn away during firing of the projectile. The case may also or alternatively comprise an electrically conductive material, such as a metallic case comprising, for example, aluminum, brass, alloys, or other suitable materials.

Figure 2:
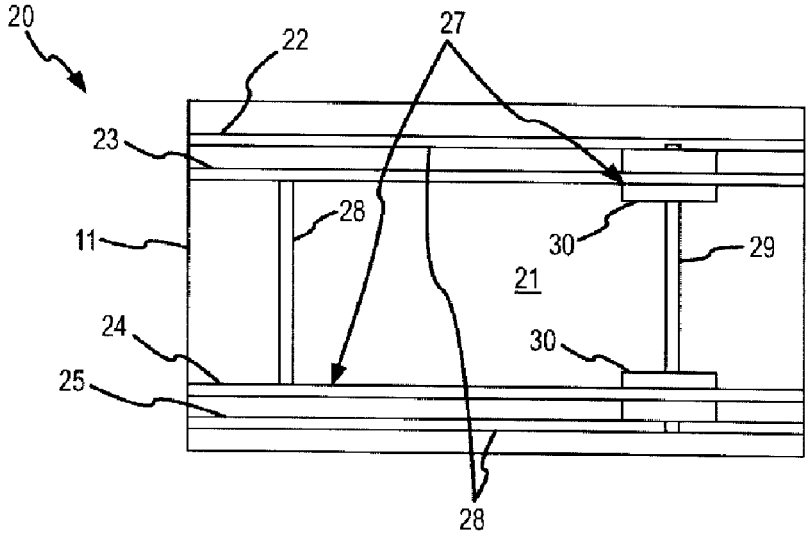
FIG. 2 is a projection of a curved inner surface of a case having a data link system.

Referring now to FIG. 2, the case 11 may further comprise a projectile data link system 20 to provide data and/or power to the projectile 12. The data link system 20 may comprise any suitable materials and be configured to provide the signals to the projectile 12, such as a set of electrical conductors, optical fibers or other optical guides, acoustic waveguides, mechanical connections, and the like. In the present embodiment, the data link system 20 comprises multiple electrical connections configured to provide electrical signals, such as instructions and/or power signals, from an external source to the projectile 12. The data link system 20 may be attached to the inner surface of the case 11. The data link system 20 of the present embodiment is electrically connected to the projectile 12 to transfer electrical signals to and/or from the projectile 12. The present data link system 20 may also be connected to one or more connections on the outer surface 14 of the case 11 to facilitate communications between an external system and the components onboard the projectile 12.

The data link system 20 may be configured for any suitable application or environment, for example in conjunction with a variety of projectiles and armament systems. For example, the data link system may comprise one or more connection points disposed on a surface of the case 11, such as the outer surface 14 and/or inner surface 21 of the case 11. One connection point is suitably formed near the base end 18 and another connection point may be formed near the forward end 17. The data link system 20 may further comprise an electrical connector disposed on a surface of the case 11 and connected to the connection points.

In the present embodiment, the data link system 20 is configured to communicate with projectiles fired from tank cannon systems and/or other armored fighting vehicles (AFVs). In use, the data link system 20 transfers electrical power and/or data signals between the external system outside the cartridge system 10 and the guidance system in the projectile 12. The data link system 20 may be configured to transmit any appropriate signals in any suitable form. For example, the data link system 20 may be configured to carry a power signal, such as to provide power to systems on board the projectile 12 and/or charge batteries. In the present embodiment, the power signal may comprise a direct and/or alternating current signal having a voltage of approximately 25 to approximately 30 volts with approximately 1 amp current flow.

In addition, the data link system 20 may be configured to provide data signals. The data signals may be provided in any suitable manner, for example by modulating or superimposing the data signals onto the power signal, such as at approximately 500 kHz. In one embodiment, the data link system 20 may transfer information at approximately 25 to approximately 50 kilobytes per second. The data may transfer any relevant information, for example information related to the firing position and velocity, vector information related to a north azimuth, and target information. The data may include global positioning information for a firing position and/or a target position.

The geometries of the various components in the data link system 20 may be selected according to any suitable criteria, such as to function at desired power and signal levels. For example, the present embodiment may comprise multiple layers of conductive and insulative materials having selected conductivities, widths, and thicknesses to accommodate relevant geometry and electrical requirements.

For example, the case 11 may comprise a non-conducting case that effectively acts as an electrical insulator. The data link system 20 is disposed on a surface of the case 11, such as a portion of the inner surface 21 of the case 11. The data link system 20 of the present embodiment comprises a grid or network of conducting material. The data link system 20 may further include insulative material, for example to insulate the conductive elements from each other. The data link system 20 may further comprise additional elements for transferring signals, such as terminals, connectors, and the like.

The present embodiment of the data link system 20 includes a first horizontal layer 23 disposed on the inner surface 21 of the case 11 at a first longitudinal position, a second horizontal layer 24 disposed on the inner surface 21 of the case 11 at a second longitudinal position, and a first vertical layer 28 disposed on the inner surface 21 of the case 11 and connected to the first horizontal layer 23 and the second horizontal layer 24 so that an electrical signal from the first horizontal layer 23 passes through the first vertical layer 28 to the second horizontal layer 24. The data link system 20 may further include a third horizontal layer 22 disposed on the inner surface 21 of the case 11 at a third longitudinal position, a fourth horizontal layer 25 disposed on the inner surface 21 of the case 11 at a fourth longitudinal position, and a second vertical layer 29 disposed on the inner surface 21 of the case 11 and connected to the third horizontal layer 22 and the fourth horizontal layer 25 so that an electrical signal from the third horizontal layer 22 passes through the second vertical layer 29 to the fourth horizontal layer 25. The data link system 20 may further include insulator pads 30 disposed between the second vertical layer 29 and the first horizontal layer 23 and the second horizontal layer 24. The data link system 20 may include a base insulation layer disposed on the inner surface 21 of the case 11 between the case 11 and the other components of the data link system 20, such as the horizontal layers, the vertical layers, and the insulator pads.

In one embodiment, the conducting material comprises the horizontal layers 22-25 of conductive material disposed on the inner surface 21 of case 11. Each of the horizontal layers 22-25 is suitably generally disposed at a longitudinal position around the longitudinal axis 13 of case 11. The horizontal layers 22-25 may fully or partially extend around the circular inner surface 21. Other systems may connect to the data link system 20 at any point on the horizontal layers 22-25, regardless of angular position around the longitudinal axis 13. For example, the projectile 12 may include a contact, such as a reciprocal annular conductor around the exterior of the projectile 12 or a conductive element projecting from the projectile, which may connect to one or more horizontal layers 22, with reduced or no angular positioning requirement around the longitudinal axis 13. Thus, connection with the horizontal layers 22-25 is not dependent on a particular angular position, but is only dependent on longitudinal alignment.

The layers 22-25 may be configured to transmit any suitable signal and be configured in any suitable manner. For example, the horizontal layers 22-25 may be comprise a top hot layer 22, top ground layer 23, bottom ground layer 24, and bottom hot layer 25. Different layers may receive transmit identical signals, such as to form groups. In the present embodiment, the horizontal layers 22-25 form a hot pair 26 comprising two of the horizontal layers 22, 25, and a ground pair 27 comprising two other horizontal layers 23, 24. The hot pair 26 and ground pair 27 may provide power and ground connections, respectively, for electrical power and/or signals delivered to the projectile 12.

The conducting material may further comprise one or more vertical layers, such as a ground vertical layer 28 and hot vertical layer 29. The vertical layers 28, 29 are suitably disposed on the inner surface 21 of the case 11 and comprise a part of the data link system 20. The conducting material may comprise any suitable number of vertical layers 28, 29, for example to electrically connect one or more of the horizontal layers 22-25. In the present embodiment, the ground vertical layer 28 electrically links the top ground layer 23 with the bottom ground layer 24. Likewise, hot vertical layer 29 electrically links the top hot layer 22 with the bottom hot layer 25. The vertical and horizontal layers may be interconnected in any suitable manner to transmit signal as desired. The vertical layers 28, 29 may extend from a position proximate the base 15 to a position proximate the opening 16. The vertical layers 28, 29 may extend parallel to the longitudinal axis 13 or in any other suitable direction.

The data link system 20 may further include one or more insulators to electrically isolate the conductors from each other, the case 11, and/or the other elements of the cartridge system 10. For example, the data link system 20 may include one or more insulator pads 30 selectively disposed between the conductive materials, for example between portions of hot and grounds layers, or between layers dedicated to transmitting different signals. For example, the horizontal layers 23, 24 may be positioned over the insulator pads 30 such that the horizontal layers 23, 24 do not make electrical contact with hot vertical layer 29. Thus, the insulator pads 30 may act as electrical insulators between the horizontal layers 23, 24 and the vertical layer 29.

Figure 3:
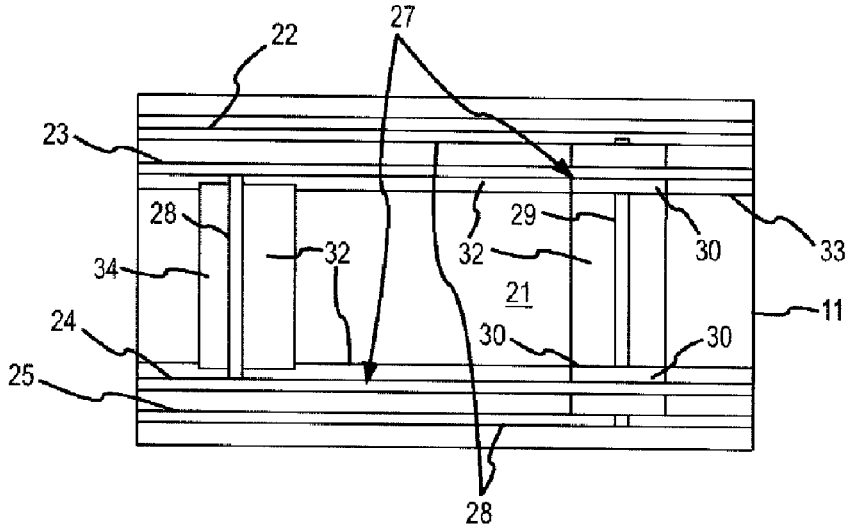
FIG. 3 is a projection of a curved inner surface of a case having a data link system with a base insulator.

The data link system 20 may also be configured to operate in conjunction with an electrically conducting case 11. For example, the data link system 20 may be electrically isolated from the case 11. Referring now to FIG. 3, the data link system 20 is disposed on a base insulation layer 32, for example on the inner surface 21 of case 11. The base insulation layer 32 has a surface that contacts inner surface 21 of case 11. The remainder of the data link system 20 may positioned on the exposed surface of the base insulation layer 32. Base insulation layer 32 insulates the electrical components of the system from the electrically conducting case 11.

The base insulation layer 32 may be configured in any suitable manner. In the present embodiment, the base insulation layer 32 is configured to match the footprint of the horizontal layers 22-25 and vertical layers 28, 29. Thus, the base insulation layer 32 may include horizontal portions 33 that underlie the horizontal layers 22-25 and vertical portions 34 that underlie the vertical layers 28, 29. Alternatively, the base insulation layer 32 may extend beyond the footprint of the data link system 20. The base insulation layer 32 may have any appropriate width and thickness to provide suitable electrical insulation between the case 11 and the conductive layers of the data link system 20.

The data link system 20 may be connected to other components, such as to transfer signals to and from the projectile 12. For example, the data link system 20 may be connected to a signal source outside the cartridge system 10, which may transfer power and data signals to and from the projectile 12 through the data link system 20. In one embodiment, near the opening 16 of the case 11, the data link system 20 may be connected, either directly or indirectly, to the projectile 12.

For example, the data link system 20 may be connected to an external system. In the present embodiment, the data link system 20 may be connected to the external system through the case 11. For example, the external portion of the base 15 may include one or more contact points that are connected to the hot pair 26 and ground pair 27 inside the case 11 to communicate signals through the case 11. In the present embodiment, the external surface of the case 11 includes at least two annular conductive bands surrounding the base 15. The exterior conductive bands are electrically connected to the hot pair 26 and ground pair 27 on the inner surface 21, such as through electrical connections penetrating through the case 11.

The exterior conductive bands may mate with a corresponding connection associated with the launching system, such as a reciprocal collar that engages the base 15 with electrical connections to make electrical contact with the data transfer system 20. The reciprocal collar may include corresponding conductive materials positioned to make contact with the exterior conductive bands when the cartridge system 10 is in position, such as within a gun and preparing to fire. Contact with the conductive bands may be made according to longitudinal alignment within the gun barrel and not any particular angular alignment of case 11 within the gun bore.

The data link system 20 may be formed and positioned in the case 11 in any suitable manner and according to any suitable techniques. For example, the data link system 20 may be integrated into the case 11 upon manufacture of the case 11 or formed in or deposited on the case 11 after the case is formed. In the present embodiment, the data link system 20 is deposited on the inner surface 21 of the case 11 in accordance with conventional techniques for depositing materials on a surface, such as by forming insulative and conductive layers via a spray painting technique, which provides relatively inexpensive and fast formation. Other painting techniques, including brush painting, may be used, as well as other conventional aspects of such techniques, such as intermediate drying periods. Alternatively, deposition techniques other than painting may be used, such as sputter depositing, extrusion, gluing, and bead formation techniques.

The materials may comprise any appropriate materials having suitable characteristics for the application. In particular, a conducting paint may be used to paint or form conducting layers, such as horizontal layers 22-25 and vertical layers 28, 29. An insulative paint may likewise be used to paint or form the non-conducting layers, such as the base insulation layer 32 and the insulator pads 30. The layer formation techniques and materials may be selected so as to be compatible with the particular application and/or environment of the cartridge system 10. For example, the materials of the data link system 20 may comprise materials that resist leaving combustion products or residues that may adversely affect the gun barrel, such as conventional soldering techniques that may potentially foul a gun barrel.

In one embodiment, the data link system 20 may comprise insulative and conductive paints and coatings supplied by Spraylat Corporation, located in Pelham, N.Y., USA. The conductive materials may comprise, for example, conductive paints, such as paints known as "silver paint" in the conductive paint industry or conducting paints containing copper. Spraylat Corporation also provides technology related to automated robotic spray painting, which may be used in the formation of the conductive layers. The data link system 20 may be formed, however, with any appropriate conductive or insulative paint or coating according to any suitable criteria, such as the application and environment of the cartridge system 10, for example residue and combustion requirements for use in bore-fired projectiles.

Referring now to FIG. 4, in one exemplary embodiment, the data link system 20 may be formed by initially preparing the case 11 (40). For example, the inner surface 21 of the case 11 may be prepared, such as to form a bond with the base insulation layer 32, the horizontal layers 22-25, and/or the vertical layers 28, 29. In the present embodiment, the inner surface 21 is initially washed and/or degreased. The inner surface 21 may also be prepared with a roughening procedure, such as a sanding of the inner surface 21. The surface preparation is suitably applied at least to those portions of the inner surface 21 where the data link system 20 is to be formed.

Figure 5:
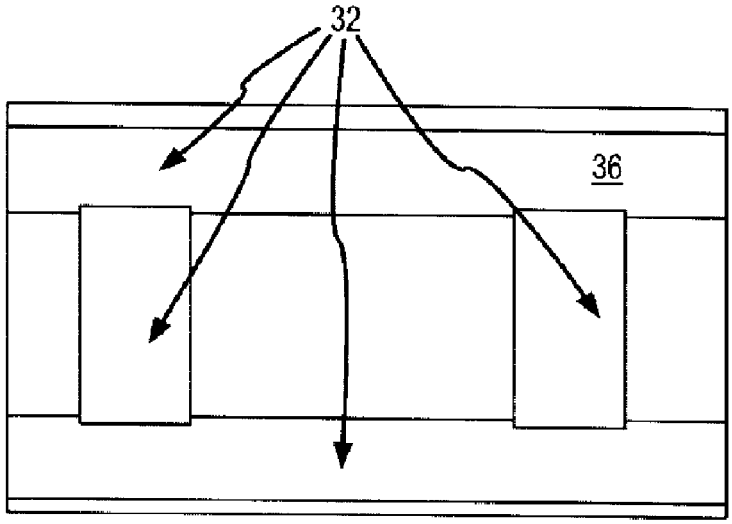
FIG. 5 is a projection of a curved inner surface of a case having a base insulator.

Referring to FIG. 5, the base insulation layer 32 may be formed on the inner surface 21, if appropriate, such as in the areas subjected to the surface preparations. The base insulation layer 32 may expose an exposed surface 36 of the base insulation layer 32. If the case 11 is a nonconducting case, the base insulation layer 32 may be omitted.

Figure 6:
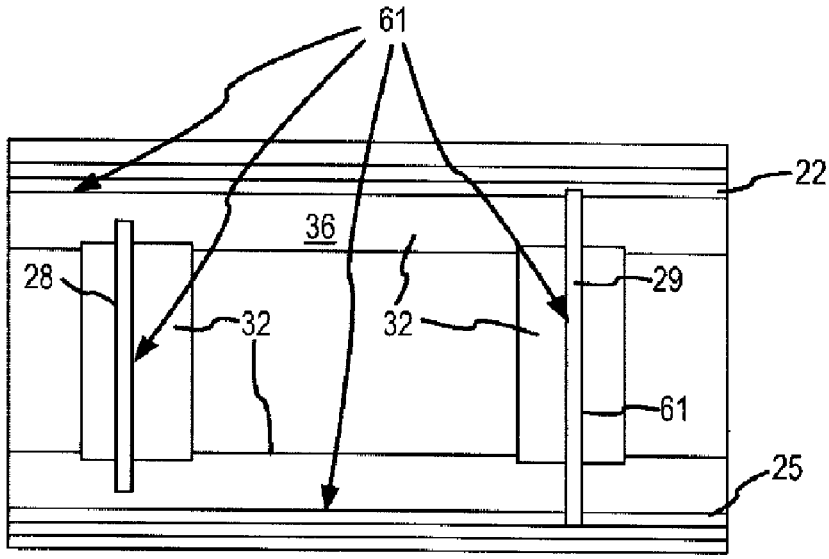
FIG. 6 is a projection of a curved inner surface of a case having a set of conductors and a base insulator.

Referring to FIG. 6, a first conductive layer may be disposed on the inner surface 21, or if a base insulation layer 32 has been formed, on the exposed surface 36 of the base insulation layer 32. The first conductive layer may form all or part of the data link system 20, such as a portion of the horizontal layers 22-25 and/or the vertical layers 28, 29. In the present embodiment, the first conductive layer forms the horizontal layers 22, 25, which correspond to the hot pair 26 of the horizontal layers. The first conductive layer also suitably forms the vertical layer 29 to connect the hot pair 26 of horizontal layers 22, 25. The first conductive layer may also form at least a portion of the ground vertical layer 28. The partial formation of the conductive layers forms an outer surface 61 of the first conductive layers.

Figure 7:
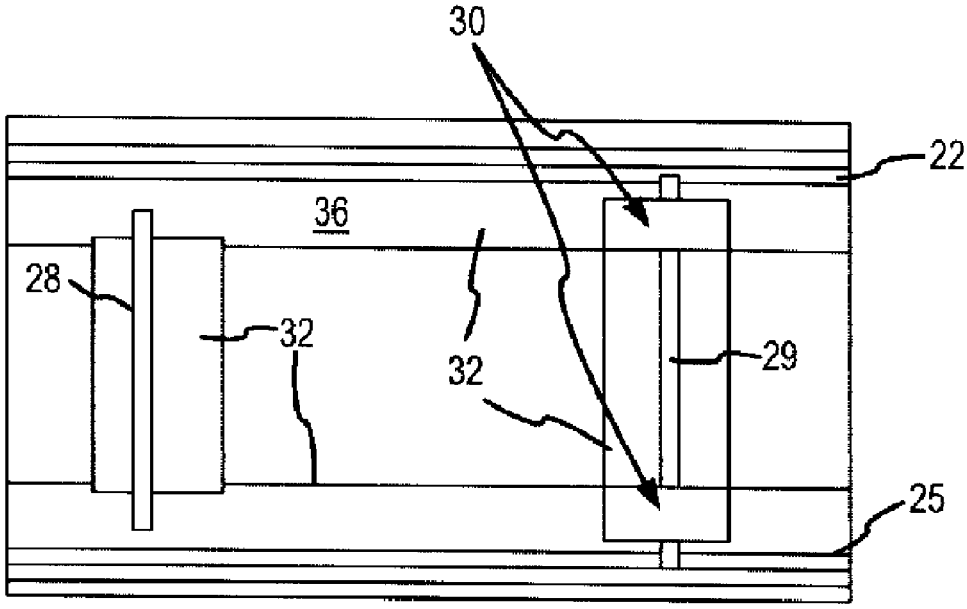
FIG. 7 a projection of a curved inner surface of a case having a set of conductors, a base insulator, and insulator pads.

Referring to FIG. 7, insulation material may be deposited in appropriate areas, such as forming insulator pads 30 in suitable locations over portions of the outer surface 61 of the first conductive layer. In the present embodiment, insulator pads 30 are formed over portions of the hot vertical layer 29.

Referring again to FIGS. 2 and 3, additional layers of conductive material and insulative material may be disposed to form the data link system 20. In the present embodiment, the final portions of the conductive layers are deposited (44). For example, conductive material may be deposited to form the horizontal layers 23, 24. The horizontal layers 23, 24 may be formed over the insulator pads 30.

Ground vertical layer 28 was only partially formed. Upon the formation of the horizontal layers 23, 24, the horizontal layers 23, 24 make contact with ground vertical layer 28 to form an electrical connection between the horizontal layers 23, 24 via the ground vertical layer 28.

The functioning portions of the data link system 20 have now been formed. All layers may be permitted to dry (45), for example using conventional drying techniques such as fans or heaters. However, practices may be followed to prevent wet paint from running beyond the desired geometry. The system may be tested (46). Upon successful testing, the cartridge system 10 may proceed to further assembly, such as insertion of propellant and attachment of the projectile 12.

While the invention has been described with reference to an exemplary embodiment, various changes may be made and equivalents may be substituted for elements thereof without departing from the scope of the invention. In addition, many modifications may be made to adapt a particular situation or material to the teachings of the invention without departing from the essential scope of the present invention. Therefore, the invention is not to be limited to the particular embodiment disclosed as the best mode contemplated for carrying out this invention, but the invention includes all embodiments falling within the scope of the appended claims.

The invention claimed is:

1. A cartridge system, comprising:

a case having a forward end and a base end;

a projectile attached to the forward end of the case; and a data link attached to a surface of the case and electrically connected to the projectile, comprising:

a first connection point disposed on the surface of the case proximate the base end of the case;

a second connection point disposed on the surface of the case proximate the forward end of the case and electrically coupled to the projectile; and an electrical connector disposed on the inner surface of the case and connected to the first connection point and the second connection point;

wherein at least one of the first connection point and the second connection point comprises a substantially annular electrical conductor disposed on the inner surface of the case.

2. A cartridge system according to claim 1, wherein at least one of the first connection point and the second connection point comprises a conductive paint.

3. A cartridge system according to claim 1, wherein the data link system further comprises a base insulation layer disposed between the inner surface of the case and the first connection point, the second connection point, and the electrical connector.

4. A cartridge system according to claim 1, wherein the data link system further comprises an insulator pad between the electrical connector and at least one of the first connection point and the second connection point.

5. A cartridge system according to claim 1, wherein the data link system further comprises:

a third connection point disposed on the surface of the case proximate the base end of the case;

a fourth connection point disposed on the surface of the case proximate the forward end of the case; and a second electrical connector disposed on the inner surface of the case and connected to the third connection point and the fourth connection point.

6. A cartridge system according to claim 1, wherein the case is configured to mate with a gun bore.

* * * * *

UNITED STATES PATENT AND TRADEMARK OFFICE

CERTIFICATE OF CORRECTION

PATENT NO. : 8,215,237 B2
APPLICATION NO. : 11/456372
DATED : July 10, 2012
INVENTOR(S) : Chris E. Geswender It is certified that error appears in the above-identified patent and that said Letters Patent is hereby corrected as shown below:

In sheet 2 of 5, fig. 2, block 28, delete “28” and insert --26--, therefor

In sheet 2 of 5, fig. 3, block 28, delete “28” and insert --26--, therefor

In column 2, line 57, delete “tiring” and insert --firing--, therefor

In column 4, line 54, delete “is” and insert --are--, therefor

In column 5, line 3, after “be”, insert --,--, therefor

In column 5, line 50, after “may”, insert --be--, therefor

Signed and Sealed this
Twenty-fifth Day of September, 2012

David J. Kappos

David J. Kappos
*Director of the United States Patent and Trademark Office*